US006694658B1

(12) United States Patent
Marsac

(10) Patent No.: US 6,694,658 B1
(45) Date of Patent: Feb. 24, 2004

(54) FIREARM REPLICA

(75) Inventor: Jerome Marsac, Laval (FR)

(73) Assignee: Les Trois Pylones, Grigny (FR)

( * ) Notice: Subject to any disclaimer, the term of this patent is extended or adjusted under 35 U.S.C. 154(b) by 0 days.

(21) Appl. No.: 09/719,240

(22) PCT Filed: May 20, 1999

(86) PCT No.: PCT/FR99/01199

§ 371 (c)(1),
(2), (4) Date: Dec. 11, 2000

(87) PCT Pub. No.: WO99/64809

PCT Pub. Date: Dec. 16, 1999

(30) Foreign Application Priority Data

Jun. 10, 1998 (FR) ..... 98 07295

(51) Int. Cl.[7] ..... F41C 3/06
(52) U.S. Cl. ..... 42/54; 124/16
(58) Field of Search ..... 124/56, 51.1, 52, 124/16; 42/11, 17, 87, 103, 84, 54

(56) References Cited

U.S. PATENT DOCUMENTS

| | | | | | |
|---|---|---|---|---|---|
| 796,982 | A | * | 8/1905 | Baribeault | |
| 2,086,339 | A | * | 7/1937 | Sosso | |
| 3,758,978 | A | | 9/1973 | Theodore | |
| 4,004,566 | A | | 1/1977 | Fischer | |
| 4,109,401 | A | * | 8/1978 | Musgrave | 42/1.01 |
| 4,580,364 | A | * | 4/1986 | Vyprachticky | 42/50 |
| 4,598,491 | A | * | 7/1986 | Noble | 42/54 |
| 4,703,826 | A | * | 11/1987 | Byron | 89/188 |
| 4,707,941 | A | * | 11/1987 | Eastman | 42/49.02 |
| 4,743,030 | A | | 5/1988 | Auer et al. | |
| 4,807,585 | A | * | 2/1989 | Gegere | 124/21 |
| 5,127,178 | A | * | 7/1992 | Sinclair | 221/92 |
| 5,206,444 | A | * | 4/1993 | Oliver | 42/1.02 |
| 5,229,531 | A | * | 7/1993 | Song | 42/58 |
| 5,303,495 | A | * | 4/1994 | Harthcock | 42/1.02 |
| 5,319,872 | A | * | 6/1994 | Bammate | 206/3 |
| 5,406,731 | A | * | 4/1995 | Stevens | 42/71.02 |
| 5,515,636 | A | * | 5/1996 | McGarry et al. | 42/117 |
| 5,581,898 | A | * | 12/1996 | Thummel | 42/114 |
| 5,613,482 | A | | 3/1997 | Thai et al. | |
| 5,669,169 | A | * | 9/1997 | Schmitter et al. | 42/75.01 |
| 5,711,286 | A | * | 1/1998 | Petrosyan et al. | 124/73 |
| 5,717,156 | A | * | 2/1998 | Lenkarski | 89/196 |
| 5,741,996 | A | * | 4/1998 | Ruger et al. | 89/196 |
| 5,758,448 | A | * | 6/1998 | Thummel | 362/114 |
| 5,954,042 | A | * | 9/1999 | Harvey | 124/48 |

* cited by examiner

*Primary Examiner*—Michael J. Carone
*Assistant Examiner*—Troy Chambers
(74) *Attorney, Agent, or Firm*—Young & Thompson

(57) ABSTRACT

A firearm replica includes a removable magazine having a case that contains projectiles such as small light balls. The balls are usually made of plastic. A frame of the firearm includes a substantially elongated part having a barrel for ejecting the projectiles, a part bent downwards acting as a grip and a receptacle for receiving therein the magazine. The elongated part contains a mechanism for ejecting the projectiles and an actuating mechanism connected to a trigger, and a breach mounted longitudinally mobile on the frame elongated part for loading a projectile in the barrel and cocking the ejecting mechanism. The firearm further includes integrated controls for immediately finding the location of a projectile which may have been blocked in the breech and/or in the frame.

3 Claims, 2 Drawing Sheets

FIREARM REPLICA

BACKGROUND OF THE INVENTION

The present invention relates to a replica of a real firearm, for example an automatic pistol or a machine pistol.

A firearm replica has for the object to reproduce faithfully the characteristics of a real firearm, particularly its weight, its volume and its real firing conditions, whilst replacing the cartridges and the percussion mechanism, by small light plastic balls and an ejection mechanism, for example compressed air.

There is already known a firearm replica comprising:

- a removable loader whose casing contains projectiles constituted of small light balls, particularly of plastic,
- a frame comprising a substantially elongated portion carrying the barrel, a downwardly elbowed portion serving as a grip, and a receptacle to receive the loader, the elongated portion of the frame containing an ejection mechanism for the projectiles and an actuating mechanism connected to a detent, and
- a slide mounted movably longitudinally on the elongated portion of the frame to load a projectile into the barrel and to cock the ejection mechanism.

However, in such a firearm replica, there is fairly frequent breakdown, by blockage of a ball between the slide and the frame, which requires taking the mechanism entirely apart, to locate the blockage site, and gives rise to supplemental costs, and trouble for the user.

SUMMARY OF THE INVENTION

The invention has for its object to facilitate disassembly of a firearm replica, in the case of possible blockage of a ball in the frame and/or in the slide.

To this end, the invention has for its object a firearm replica of the mentioned type, characterized in that it comprises control means integrated to locate, without preliminary disassembly, the site of possible blockage of a projectile in the slide and/or the frame.

Preferably, the control means is constituted by at least a portion of the slide end of the frame of transparent plastic material. Preferably, the assembly of the slide and frame is of transparent plastic. In this case, the control means also promotes locating possible breakdown in the ejection mechanism and/or the actuating mechanism.

According to another characteristic, an indicator means is provided to indicate the size and number of balls available in the loader. Preferably, this indicator means is constituted by at least a portion of the loading housing in transparent plastic material. Preferably, the assembly of the loading housing is of transparent plastic material.

According to still another characteristic, the firearm replica of the invention comprises balancing means to simulate firing conditions of a real firearm. Preferably, the balancing means comprise a counterweight in the elongated portion of the frame, substantially in vertical alignment with a trigger guard surrounding the trigger. The balancing means can also comprise a counterweight fixed along the grip at its rear surface. The loader can also comprise a counterweight disposed between the legs of a U shaped recess forming a reservoir for the projectiles.

In a first embodiment, the ejection mechanism is provided to eject the projectile with an energy of the order of 0.5 J to simulate the firing conditions of a real firearm, whilst in a second embodiment, for a toy, the ejection energy is of the order of 0.08 J.

Preferably, the grip is covered with two removable protective covers of transparent plastic material, said covers defining along the rear surface of the grip a recess to receive the mentioned counterweight.

BRIEF DESCRIPTION OF THE DRAWINGS

The invention will be better understood and other objects, details, characteristics and advantages of the latter will become more clearly apparent, in the course of the explanatory detailed description which follows, of a particular embodiment of the invention that is presently preferred, given solely by way of illustration and not limitation, with reference to the accompanying schematic drawings, in which.

DETAILED DESCRIPTION OF THE PREFERRED EMBODIMENTS

Figure 1:
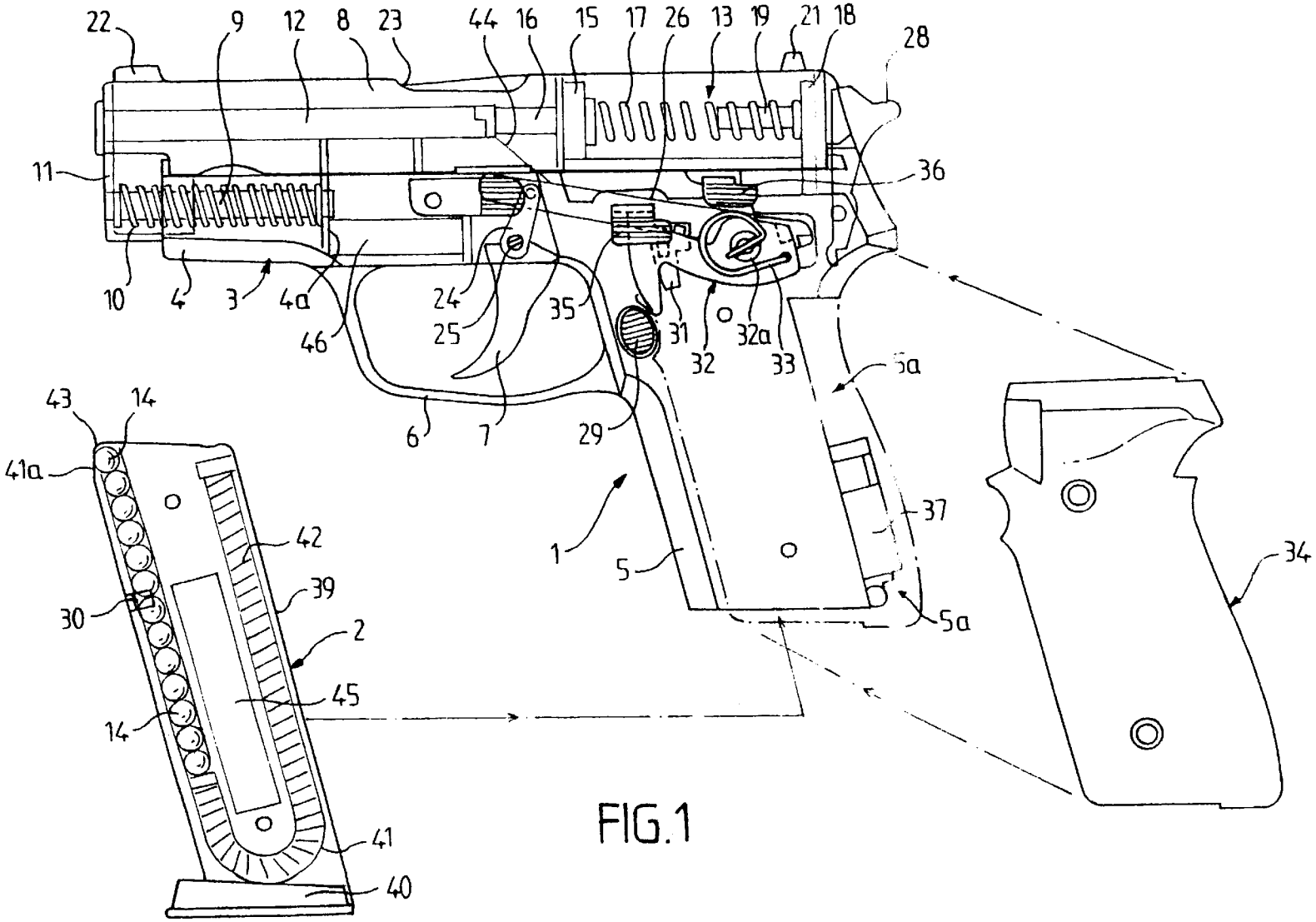
FIG. 1 is an exploded elevational view of a firearm replica according to the invention.

According to the embodiment shown in the drawings, the firearm replica of the invention is in the form of an automatic pistol 1, with a removal magazine 2.

The firearm replica 1 comprises a fixed frame 3 constituted by an elongated body 4 extending rearwardly, with a downwardly elbowed portion 5, which serves as a grip. A trigger guard 6 extends between the lower surface of the elongated body 4 and the front surface of the grip 5, to receive a trigger 7. The upper portion of the elongated body 4 is surmounted by a longitudinally movable slide 8.

The elongated body 4 of the frame 3 comprises a guide rod 9 which extends forwardly. A return spring 10 is mounted coaxially on the guide rod 9 and bears, with one end turn, on a fixed abutment 4*a* on the frame 3, and by the opposite end turn against a tongue 11 which projects downwardly from the slide 8.

The elongated body 4 and the frame 3 carry, above the guide rod 9, the barrel 12 to eject the projectiles. The barrel 12 can be provided in metallic material.

In rearward prolongation of the barrel 12, there is provided an ejection mechanism 13 for projectiles in the form of small light plastic balls 14. The ejection mechanism 13 comprises within the elongated body 4 of the frame 3, a piston 15, at the center of which is provided a pressure pin 16 which projects in the direction of the barrel 12. A helicoidal ejection spring 17 bears, on the one hand, against the surface of the piston 15 opposite the pin 16, and on the other hand, against a flange 18 which projects above the elongated body 4. A guide pin 19 extends longitudinally from this projecting flange 18 to serve to guide the ejection spring 17, in the course of its cocking, and in the course of ejection. As in a real firearm, the slide 8 has on its upper surface a rear sight 21 and a front sight 22. To simulate a real firearm, an indentation 23 is provided on the other side of the slide 8, substantially at its center, said indentation 23 serving, in a real firearm, to eject cartridge cases after firing. Of course, in this case the slide 8 does not undergo a recoil movement during firing, because the ejection energy of the projectiles is too low.

In the elongated body 4 is also provided an actuating mechanism connected, on the one hand, to the trigger 7, and, on the other hand, to the ejection mechanism 13. This actuating mechanism comprises a lever 24 secured to the trigger 7, at its articulation axle 25 on the frame 3. The opposite end of the lever 24 is articulated to a bar 26 which is adapted to move substantially in its longitudinal direction under the actuation of the trigger 7.

Figure 2:
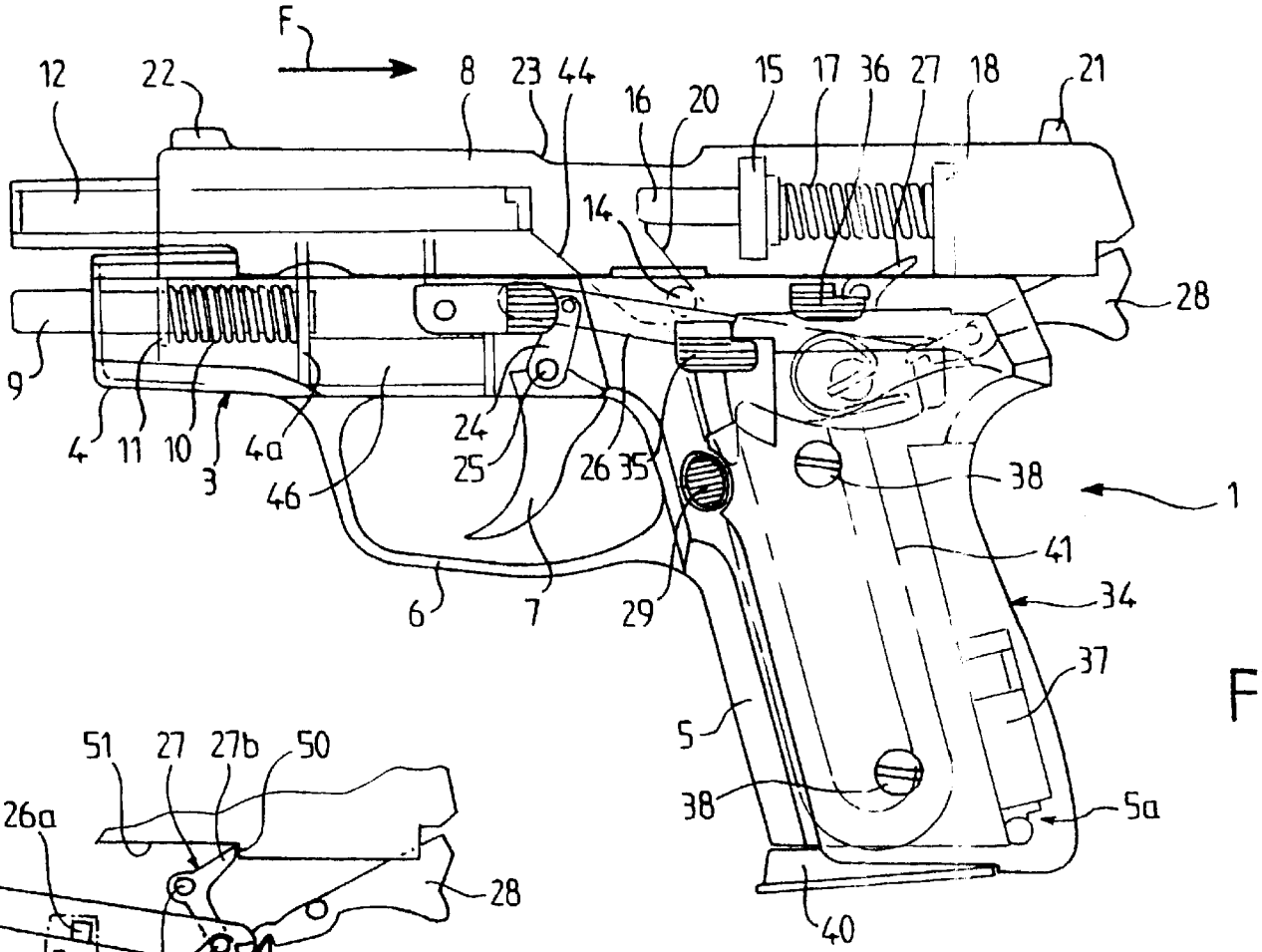
FIG. 2 is a view similar to FIG. 1, showing the firearm replica in the course of loading, with the slide in retracted position.
Figure 3:
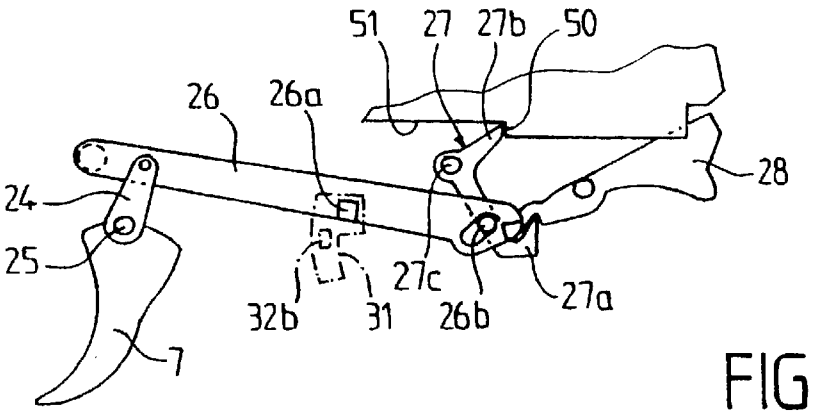
FIG. 3 is an enlarged view of the kinematic mechanism chain of actuation of the firearm replica of FIG. 2.

As shown in FIG. 3, the bar 26 is secured by an articulated connection 26*b* to a leg 27*a* of a sear 27, to cause the sear 27 to swing about its pivot point 27*c* (see FIG. 3) during movement of the bar 26. The sear 27 comprises another leg 27*b* which is adapted to coact with a notch 50 of a tongue 51 secured to the piston 15, to retain the piston 15 in its retracted position, shown in FIG. 2. The leg 27*a* of the sear 27 moreover comprises a hook adapted to coact with a hammer 28 which is articulated at the rear of frame 3. The hammer 28 hooks onto the leg 27*a* of the sear 27, when the hammer 28 is swung downwardly, under the action of the rear edge of the slide 8 which is moved rearwardly in the direction of the arrow F, as shown in FIG. 2. The hammer 28 in this case has only the function of giving a sound, because the firearm replica does not use percussion.

The grip 5 of the firearm replica 1 is hollow and open at its base to define a receptacle for receiving the magazine 2. The grip 5 comprises a pushbutton 29 extending transversely and adapted to coact with a notch 30 in the magazine 2 to block it in the receptacle of the grip. One of the surfaces of the grip 5 comprises a slot 31 (see FIG. 3) of substantially inverted L shape, in which engages a lug 26*a* projecting from the bar 26. The projecting lug 26*a* is adapted to move substantially longitudinally in the base of the L, during actuating movement of the trigger 7. A safety 32 is articulated on said surface of the grip 5 and is provided with an angular return spring 33 at the level of its axle of articulation 32*a*. The safety 32 comprises a lug 32*b* which projects into the slot 31 and is adapted to move along the substantially vertical leg of the L. In the upper position of the safety 32, the projecting lug 32*b* blocks the movement of the lug 26*a* projecting from the bar 26, which prevents movement of the trigger 7.

The grip 5 is covered on each of its surfaces with a protective cover 34. One of the covers 34 covers the safety 32, except its free end 35 which extends beyond the cover 34 to permit swinging of the lever between an active position blocking the trigger 7 and a lower inactive position. A retaining tongue 36 is provided on each side of the frame 3 to retain the upper edge of each cover 34. Once assembled, the two covers 34 define along the rear edge of the grip 5 a substantially vertical recess 5*a* in which is disposed a metallic counterweight 37. Each cover 34 is fixed on the grip 5 by two small screws 38.

The magazine 2 comprises a body 39 extending substantially vertical with a slight inclination to correspond to that of the grip 5, and a substantially horizontal base 40, which is adapted to close the open bottom of the receptacle of the grip 5. The body 39 of the magazine 2 comprises a substantially U shaped recess 41 extending substantially in the plane of symmetry of the firearm replica, a compression spring 42 being disposed within the recess 41, so as to be able to occupy all the internal space of this recess. The recess 41 opens at its upper front end through an opening 41*a*, to permit the introduction of balls 14 into the magazine 2 and the exit of the balls during the cocking of the firearm replica. The balls 14 contained in the recess 41 press back the spring 42 and are urged by the spring 42 toward an upper flange 43 of the magazine 2 which is in line with the outlet opening 41*a*, which prevents the untimely exit of the balls 14. A proportion of the magazine 2 comprises a longitudinal slot in which an active portion of the slide 8 engages during recoil, said active portion thus pressing back the balls into the recess 41, to cause the uppermost ball to coincide with the outlet opening 41*a*, thereby permitting the loading of a ball 14 into the barrel 12. A guide ramp 44 is provided in the elongated body 4 of the frame 3, to guide the ball 14 between the outlet opening 41*a* of the magazine 2 and the inlet of the barrel 12. The slide 8 moreover comprises a pressing ramp 20, seen in FIG. 2, which is adapted, during return of the slide 8 toward its rest position, to press the ball 14 toward the ramp 44, until the ball 14 reaches the inlet of the barrel 12.

As seen in FIG. 1, between the legs of the U shaped recess 41 of the magazine 2, is disposed a metallic counterweight 45. Similarly, a metallic counterweight 46 is disposed in the elongated body 4 of the frame 3, substantially in vertical alignment with the trigger guard 6. The counterweights 37, 45 and 46 have the purpose of balancing the firearm replica 1, so as to simulate real firing conditions and the heft of a real firearm. In general, the mass of the firearm replica is less than that of a real firearm, but it tends to approach it.

An essential characteristic of the invention is that the assembly of the frame 3, the slide 8, the magazine 2 and the protective covers 34 is a transparent plastic material. Thus, the user can control the good operation of the actuating mechanism and of the ejection mechanism of the firearm replica, and particularly, immediately locate the site of possible blockage of a ball 14 in the slide and/or the frame. Moreover, the user can immediately determine the size and number of balls available in the magazine 2. The fact of providing the firearm replica 1 in transparent plastic material also permits visualizing the animation of the mechanisms of the firearm replica. Of course, as a modification, it could be provided that only a portion of the firearm replica 1 be in transparent plastic material, to obtain the desired effects of controlling possible malfunction and the identification of the number and size of the balls.

Finally, it will be noted that the ejection mechanism of the firearm replica can be of the compressed air type, with gas, or with electrical actuation, with or without a spring.

By way of example, the balls can have a dimension of the order of 6 mm.

The operation of the firearm replica will now be described with reference to FIGS. 1 and 2.

In the rest position shown in FIG. 1, with the magazine 2 engaged in the receptacle of the grip 5, the safety 32 is in a downwardly swung position to permit operation of the trigger 7.

Then, a longitudinal force is exerted in the direction of the arrow F in FIG. 2 to press rearwardly the slide 8 relative to the frame 3, which has the effect of uncovering the forward portion of the barrel 12, and free end of the guide rod 9. Simultaneously, the piston 5 is pressed rearwardly against the ejection spring 17 and the hammer 28 is swung downwardly. The hammer 28 is maintained in downwardly swung position by the sear 27 which retains the piston 15 in retracted position by means of the tongue 51. The rearward movement of the slide 8 also causes the ejection of a ball 14 as shown in FIG. 2.

The return of the slide 8 to its rest position is ensured by the return spring 10 at the level of the guide rod 9. This return movement of the slide 8 moves the ball 14 along the ramp 44 to the inlet of the barrel 12, under the action of the pressure ramp 20. In this position, the pin 16 of the piston 15 is spaced from the ball 14, because the piston 15 is retained by the sear 27. When the user pulls the trigger, the bar 26 is driven forwardly, by means of the lever 24, which causes the sear 27 to pivot and frees the tongue 51 from the piston 15 which is propelled forwardly under the action of the ejection spring 17. The swinging of the sear 27 also frees the hammer 28 which strikes the rear of the frame 3 with a clapping sound. The piston 15 is projected forwardly, until its pin 16 strikes the ball 14 which is ejected through the barrel 12 to the exterior. It should be noted that during firing ball 14, a ball 14 does not automatically replace the ball which has been projected. It is necessary, for this purpose, again to retract the slide 8.

Although the invention has been described in connection with a particular embodiment, it is evident that it is in no way thereby limited and that it comprises all technical equivalents of the means described, as well as their combinations if the latter enter into the scope of the invention. The firearm replica of the invention can particularly be adapted for its use as a plaything.

What is claimed is:

1. Firearm replica comprising:

a removable magazine having a housing containing projectiles constituted by small light balls;

a frame comprising a substantially elongated portion carrying a barrel through which said projectiles are ejected, a downwardly elbowed portion serving as a grip and a receptacle to receive said removable magazine, said elongated portion of said frame containing an ejection mechanism for ejecting said projectiles and an actuating mechanism connected to a trigger;

a slide mounted longitudinally moveable on said elongated portion of said frame to load a projectile into said barrel and to cock said ejection mechanism;

an integral blockage control means to localize, without previous disassembly, a site of possible blockage of a projectile in at least one of said slide and said frame, said blockage control means being constituted by at least a portion of said slide and of said frame in transparent plastic material;

balancing means to simulate conditions of firing a real firearm, wherein the balancing means comprise a first counterweight secured along the grip, on a rear surface thereof; and a second counterweight disposed in said magazine between legs of a U-shaped recess forming a reservoir for said projectiles.

2. Firearm replica comprising:

a removable magazine having a housing containing projectiles constituted by small light balls;

a frame comprising a substantially elongated portion carrying a barrel through which said projectiles are ejected, a downwardly elbowed portion serving as a grip and a receptacle to receive said removable magazine, said elongated portion of said frame containing an ejection mechanism for ejecting said projectiles and an actuating mechanism connected to a trigger;

a slide mounted longitudinally moveable on said elongated portion of said frame to load a projectile into said barrel and to cock said ejection mechanism;

an integral blockage control means to localize, without previous disassembly, a site of possible blockage of a projectile in at least one of said slide and said frame, said blockage control means being constituted by at least a portion of said slide and of said frame in transparent plastic material; and balancing means to simulate conditions of firing a real firearm, wherein the balancing means comprise a first counterweight secured along the grip, on a rear surface thereof, and wherein said grip is covered by two removable protective covers of transparent plastic material, said covers defining along said rear surface of said grip a recess to receive said first counterweight.

3. Firearm replica according to claim 1, wherein said second counterweight is metallic.

* * * * *